US006606075B1

(12) United States Patent
Chun

(10) Patent No.: US 6,606,075 B1
(45) Date of Patent: Aug. 12, 2003

(54) MODULAR WIRELESS BROADBAND ANTENNA TOWER

(75) Inventor: Ki Chun, Lehi, UT (US)

(73) Assignee: Luxul Corporation, North Salt Lake, UT (US)

( * ) Notice: Subject to any disclaimer, the term of this patent is extended or adjusted under 35 U.S.C. 154(b) by 0 days.

(21) Appl. No.: 09/877,927

(22) Filed: Jun. 7, 2001

(51) Int. Cl.[7] ..... H01Q 1/12

(52) U.S. Cl. ..... 343/890; 343/891; 343/893; 343/895

(58) Field of Search ..... 343/890, 891, 343/892, 893, 878, 895, 872, 874

(56) References Cited

U.S. PATENT DOCUMENTS

| | | | | | |
|---|---|---|---|---|---|
| 2,630,530 | A | | 3/1953 | Adcock et al. | 250/33.57 |
| 2,835,893 | A | | 5/1958 | Braund | 343/895 |
| 3,509,578 | A | | 4/1970 | Cribb | 343/873 |
| 3,594,802 | A | | 7/1971 | Koob | 343/705 |
| 3,623,116 | A | | 11/1971 | Green et al. | 343/788 |
| 3,975,733 | A | | 8/1976 | Bogner | 343/770 |
| 3,988,737 | A | | 10/1976 | Middlemark | 343/809 |
| 4,804,972 | A | | 2/1989 | Schudel | 343/840 |
| 4,899,500 | A | | 2/1990 | Miller et al. | 52/146 |
| 4,912,893 | A | | 4/1990 | Miller et al. | 52/79.1 |
| 4,951,433 | A | | 8/1990 | Miller et al. | 52/126.6 |
| 5,041,842 | A | * | 8/1991 | Blaese | 343/882 |
| 5,089,824 | A | | 2/1992 | Uematsu et al. | 342/359 |
| 5,291,211 | A | * | 3/1994 | Tropper | 343/700 MS |
| 5,467,955 | A | * | 11/1995 | Beyersmith | 248/219.3 |
| 5,537,125 | A | | 7/1996 | Harrell, Jr. et al. | 343/878 |
| 5,760,751 | A | | 6/1998 | Gipson | 343/880 |
| 5,787,111 | A | | 7/1998 | Gilmore | 375/200 |
| 5,787,673 | A | * | 8/1998 | Noble | 343/890 |
| 5,888,701 | A | * | 3/1999 | Fan | 430/270.1 |
| 5,912,646 | A | | 6/1999 | Seki et al. | 343/700 MS |
| 5,969,689 | A | | 10/1999 | Martek et al. | 343/758 |
| 5,999,145 | A | * | 12/1999 | Niekamp | 343/800 |
| 6,047,160 | A | | 4/2000 | Priest et al. | 455/11.1 |
| 6,104,910 | A | | 8/2000 | Koths | 455/11.1 |
| 6,172,654 | B1 | * | 1/2001 | Martek | 342/375 |
| 6,229,497 | B1 | * | 5/2001 | McCracken | 248/188.5 |
| 6,249,261 | B1 | * | 6/2001 | Solberg et al. | 343/801 |
| 6,268,828 | B1 | * | 7/2001 | Martek | 342/373 |

OTHER PUBLICATIONS

Lawrence Harte, "CMDA IS–95 for Cellular and PCS," (1999) pp. 177–188.

* cited by examiner

*Primary Examiner*—Tan Ho

(57) ABSTRACT

A preconfigured antenna assembly for use in a target topographic region. The antenna assembly includes an antenna chassis covered by a radome cover and a set of antennas mounted to the chassis. The mounting mechanism for each antenna allows each antenna to be aimed by adjusting an angle of inclination between a long axis of the antenna and a plane defined by the antenna chassis. The antennas are separated by an angular and linear spacing to minimize interference between adjacent antennas and provide a desired signal coverage for the antenna assembly.

16 Claims, 8 Drawing Sheets

MODULAR WIRELESS BROADBAND ANTENNA TOWER

RELATED APPLICATION

None.

TECHNICAL FIELD

The present invention relates to a portable wireless broadband transmitting and receiving antenna tower having a modular construction and being preconfigurable for a target topographic region and to an organization of such towers.

BACKGROUND OF THE INVENTION

A typical cell tower rises over 100 feet in the air and is a complicated structure requiring significant time, effort, and equipment to construct. Typically, the tower will have three or four faces with one or more antennas on each face of the structure. When additional network capacity is needed, a service provider usually must build an additional cell tower because the typical cell tower is not scalable.

Miller, et al., U.S. Pat. No. 4,912,893, disclose a typical prior art cell site. The cell tower is constructed on top of a building and guyed by several wires. The tower itself consists of several tower pieces mounted together and attached to the roof of the structure, extending upward. Antennas can be mounted on the sides of the tower pieces.

Gillmore, U.S. Pat. No. 5,787,111, discloses a transportable wireless network for serving a geographic region, specifically in a disaster environment. It consists of one or more cell cites, one or more wired access points, and a common point that facilitates communication between one or more user terminals and an established communications network. Gillmore also discloses a portable cell site consisting of a tower, either rigid or telescoping; a trailer that is adapted for being towed; and a power source.

Koths, U.S. Pat. No. 6,104,910, discloses a mobile relay station made up of a mobile base (a kind of trailer adapted for being towed) with a mast for supporting an antenna, the mast being guyed over spreaders and connected to the sides of the base without connection to the ground.

The need remains for a modular cell tower that is easier to transport to a target cell site, is easier to assemble at the cell site, and can be preconfigured for a target topographic region.

SUMMARY OF THE INVENTION

An antenna assembly in accordance with the present invention is preconfigured for use in a target topographic region. The antenna assembly includes an antenna chassis enclosed in a cover and a set of antennas mounted to the chassis. The mounting mechanism for each antenna allows each antenna to be aimed by adjusting the angle of inclination between a long axis of the antenna and a plane defined by the antenna chassis. The antennas are separated by an angular and linear spacing to minimize interference between adjacent antennas and provide a desired signal coverage for the antenna assembly.

In accordance with the present invention, a preconfigurable antenna assembly is adapted for connection to a radio and for use in broadband communications in a target topographic region that has a known topography. The antenna assembly comprises an antenna chassis, a set of antennas, a signal amplifier, and a cover. The antenna chassis has a set of mounting brackets. Each mounting bracket is positioned along a radii of the antenna chassis and spaced apart by a predetermined linear or angular distance and define a generally planar relationship. A set of antennas is mounted to the set of mounting brackets. The predetermined distance separating the mounting brackets is large enough that a signal from one of the antennas mounted to one of the mounting brackets will be substantially free from interference from a signal from an adjacent one of the antennas mounted to an adjacent one of the mounting brackets. Each of the antennas has an antenna axis and includes a mounting device for attaching to one of the mounting brackets. The mounting device allows an antenna angle of inclination, the angle between the antenna axis and the generally planar relationship defined by the mounting brackets, to be independently rotatably adjustable relative to the generally planar relationship defined by the set of mounting brackets. This design allows each antenna to be aimed based on the topography of the target topographic region prior to installation at the target topographic region. A signal amplifier rests on the antenna chassis and is operably connected to one of the antennas. The signal amplifier is adapted for connection to the radio. A cover is mounted to the antenna chassis and encloses at least a portion of the antenna chassis.

In accordance with one embodiment of the present invention, a portable broadband antenna tower for use in a target topographic region comprises a base unit, a post supported on the base unit, a first antenna chassis positioned on the post, a second antenna chassis and a first and second set of antennas. The first antenna chassis is positioned on the post at a first predetermined vertical distance from the base unit. The first antenna chassis has a set of first recesses spaced apart by a predetermined distance about the first antenna chassis and positioned in a first generally planar relationship. The first recesses are sized for receiving a set of first antennas. The second antenna chassis is positioned at a second predetermined vertical distance from the base unit and has a set of second recesses. The second recesses are spaced apart by a predetermined distance in a second generally planar relationship. The second recesses are sized for receiving a second set of antennas. The first and second sets of antennas are rotatably mounted in the first and second recesses, respectively. This allows each antenna to be adjusted based on the target topographic region.

Additional aspects and advantages of this invention will be apparent from the following detailed description of preferred embodiments thereof, which proceeds with reference to the accompanying drawings.

DETAILED DESCRIPTION OF PREFERRED EMBODIMENT

Figure 1:
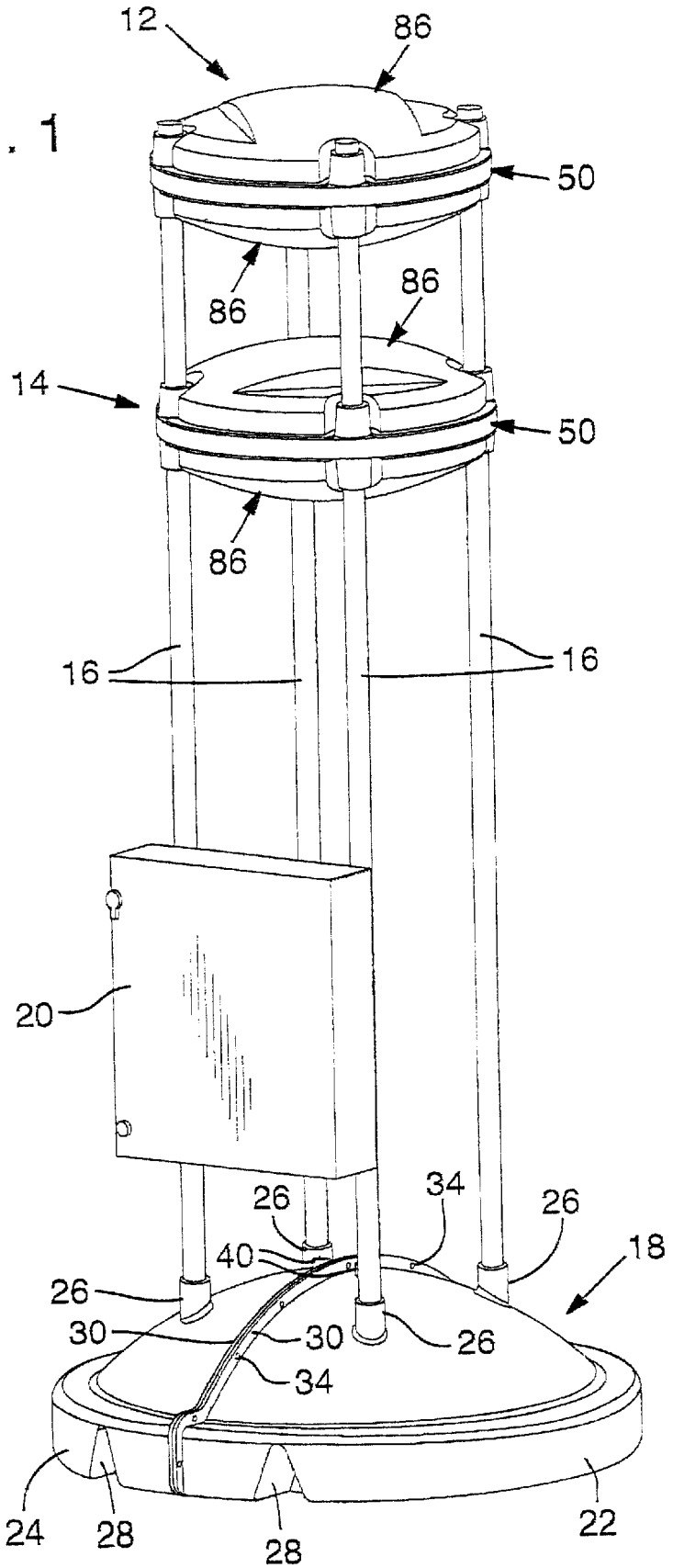
FIG. 1 is a perspective view of a modular radio-frequency antenna tower in accordance with the present invention.

FIG. 1 is a perspective view of a modular radio-frequency antenna tower 10 in accordance with the present invention. Antenna tower 10 comprises a first antenna assembly 12, a second antenna assembly 14, a set of posts 16, a base unit 18,and an electronics box 20. With reference to FIG. 1, base unit 18 comprises a right half 22 and a left half 24. Posts 16 are supported by base unit 18 and extend generally upward from base unit 18. Preferably, posts 16 are hollow tubes, each being approximately 10 feet long 1¼ inch OD sheet pipe. Electronics box 20 is attached to one of posts 16 adjacent to base unit 18. Electronics box 20 houses a radio (not shown) for antenna tower 10. Preferably the radio is a model BR 342, 11 Mbps, 802.11 b radio, manufactured by Cisco Systems. Electronics box 20 is adapted for operably connecting the radio to first antenna assembly 12 or second antenna assembly 14. First antenna assembly 12 rests on posts 16 at a first predetermined vertical distance from base unit 18. Second antenna assembly 14 rests on posts 16 at a second predetermined vertical distance from base unit 18. Preferably the difference between the first and second predetermined vertical distances is sufficient to reduce signal interference between antenna assemblies 12 and 14. In the presently preferred embodiment the difference between the first and second predetermined vertical distances is approximately 24 inches and results in approximately a 35–40 dB attenuation in signal strength between first antenna assembly 12 and second antenna assembly 14. The 35–40 dB attenuation serves to isolate each antenna assembly from noise produced by the other antenna assembly. It is known in the art that the difference between the first an second predetermined vertical distances may be varied in order to have a desired level of attenuation between first antenna assembly 12 and second antenna assembly 14.

Figure 2:
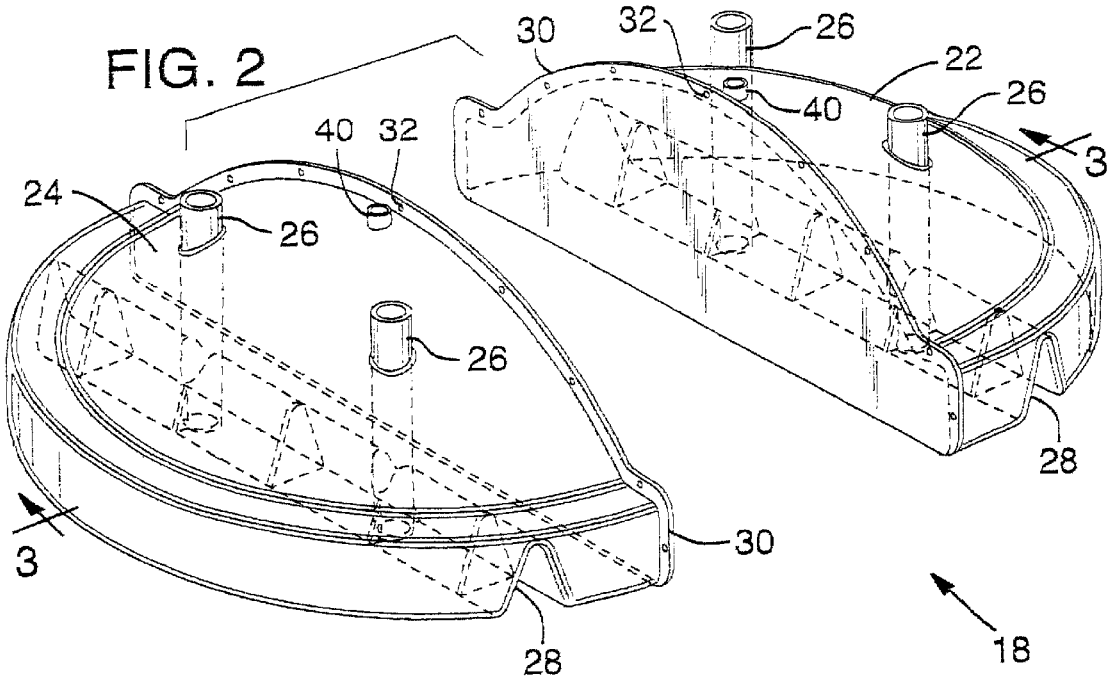
FIG. 2 is an exploded perspective view of a base unit of the modular radio-frequency antenna tower of FIG. 1.
Figure 3:
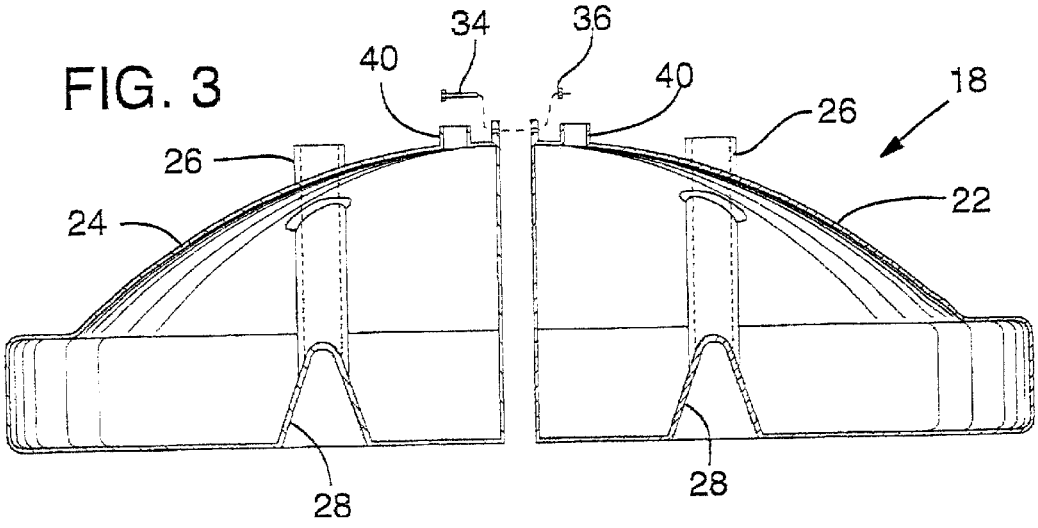
FIG. 3 is a sectional view of a base unit of FIG. 2.

FIG. 2 is an exploded perspective view of base unit 18 of antenna tower 10. FIG. 3 is a sectional view of base unit 18, taken along line 3—3 of FIG. 2. With reference to FIGS. 2 and 3, base unit 18 comprises a right half 22 and a left half 24. Both left half 24 and right half 22 include a set of post holes 26 for receiving posts 16 and a support ridge 28 for supporting posts 16. In addition, both left half 24 and right half 22 include an attachment edge 30, which includes a set of attachment holes 32. Left half 24 is attached to right half 22 by inserting a bolt 34 into attachment holes 32 and securing a nut 36 to bolt 34. Left half 24 and right half 22 are both hollow and include a fill hole 40, so that each half is adapted for receiving a ballast, preferably water or sand. Preferably each half of base unit 18 is made of polyethelene and the two halves can receive a ballast weighing around 800 to 1000 pounds.

Figure 4A:
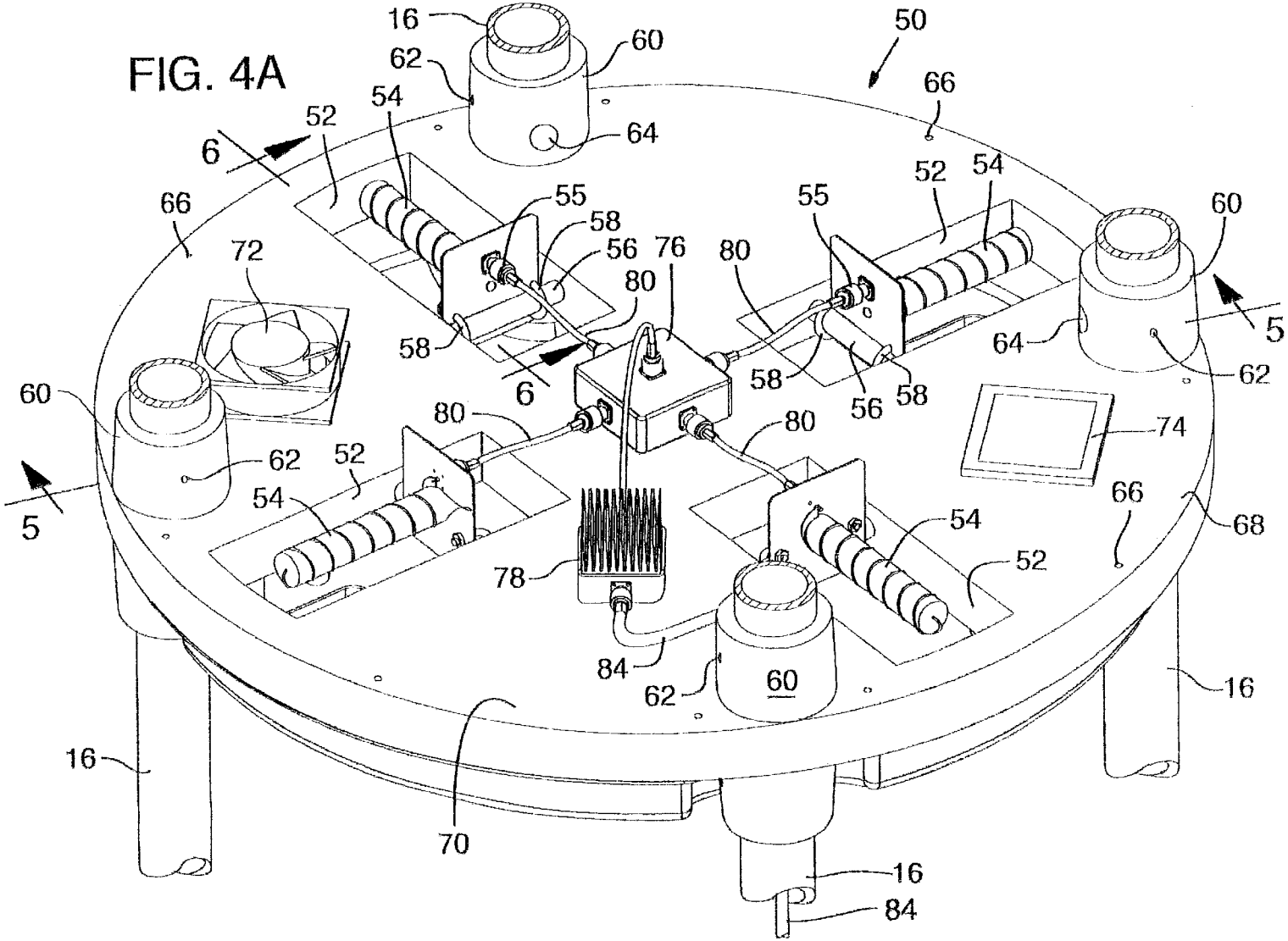
FIG. 4A is perspective view of an antenna chassis of an antenna assembly of the modular radio-frequency antenna tower of FIG. 1
Figure 4B:
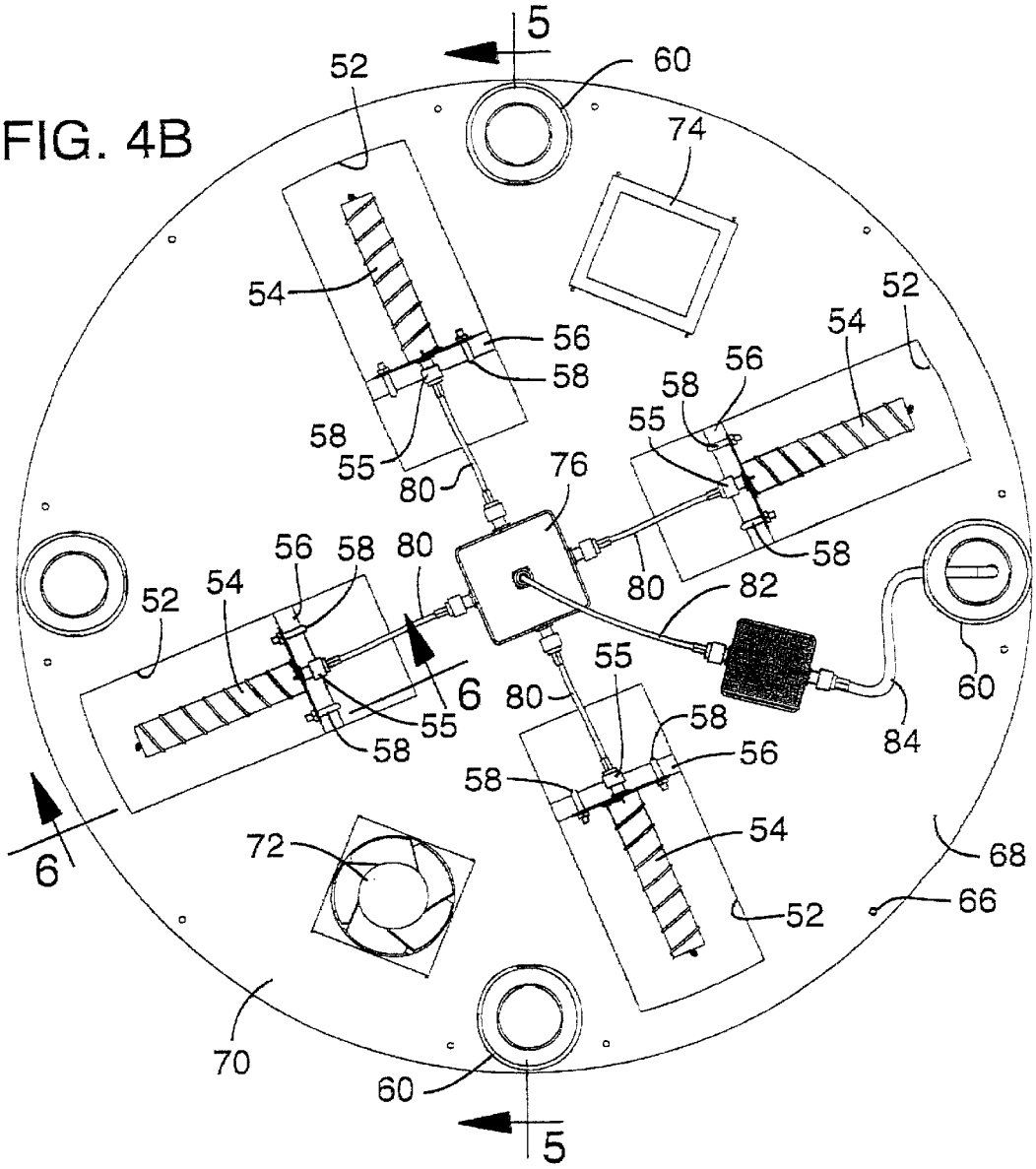
FIG. 4B is a top plan view of the antenna chassis of FIG. 4A.

FIGS. 4A and 4B are respective perspective and top plan views of a first antenna chassis 50 of first antenna assembly 12 of antenna tower 10. With reference to FIGS. 4A and 4B, first antenna chassis 50 includes a set of first recesses 52 for receiving a set of first antennas 54. First recesses 52 are each aligned along a radius of first antenna chassis 50, spaced a predetermined angular distance from one another about first antenna chassis 50, and define a generally planar relationship. Each first recess 52 is positioned along a radii of first antenna chassis 50 at a predetermined linear distance from a center of first antenna chassis 50. When first antennas 54 are mounted in first recesses 52 each first antenna 54 is a minimum linear antenna spacing distance of approximately 14 inches from adjacent first antennas 54. The minimum linear antenna spacing distance is the linear distance between a connector 55 located at the base of a first antenna 54 and the connector 55 of an adjacent first antenna 54. This minimum linear antenna spacing distance results in an approximately 35–40 dB attenuation between adjacent first antennas 54. The minimum linear antenna spacing distance can be used in conjunction with other factors, such as the frequency difference between channels used by adjacent first antennas 54 and the polarization, either right-hand or left-hand, of adjacent first antennas 54, to produce a desired minimum attenuation between signals produced by adjacent first antennas 54.

Each first antenna 54 includes an antenna axis 57 (FIG. 6), which in the preferred embodiment corresponds to the axis along which a radio signal from each first antenna 54 propagates. Each first antennas 54 is rotatably mounted in one of first recesses 52 in a way that allows an antenna angle of inclination θ (FIG. 6), the angle between antenna axis 57 and a chassis axis 59 (FIG. 6) corresponding to the generally planar relationship defined by first recesses 52, to be adjusted based on the topography of the target topographic region. In a presently preferred embodiment, first antennas 54 are rotatably mounted into first recesses 52 by attaching first antennas 54 to a set of antenna mounting posts 56 with a set of fasteners 58 and the range of adjustment for antenna angle of inclination θ is approximately +15 degrees to −15 degrees. In a currently preferred embodiment, fasteners 58 comprise U-bolts of an appropriate size for securing first antennas 54 to antenna mounting posts 56. This design allows the antennas to be aimed, by adjusting antenna angle of inclination θ for each first antenna 54, based on the topography of a target topographic or geographic region. Any mounting mechanisms may be used in accordance with the present invention that allows first antennas 54 to be aimed by adjusting the antenna angle of inclination for each first antenna 54, and securing each first antenna 54 at that adjusted antenna angle. The mounting mechanism should be secure enough to prevent each antenna angle of inclination from slipping during normal shipping and installation while remaining adjustable to allow for re-aiming each first antenna 54 at a later time. Such mounting mechanisms could include a slotted metal plate with a ball and socket joint, a hinge with a securing mechanisms, or any other mounting mechanisms that can perform the above described functions. In an alternative embodiment (not shown), first antennas 54 are mounted to mounting brackets (not shown) or posts (not shown), near a peripheral edge (not shown) of an alternate antenna chassis (not shown). The mounting brackets or posts are a predetermined distance from one another. In another alternative embodiment (not shown), first antennas 54 are pivotally mounted to first antenna chassis 50, so that first antennas 54 may be adjusted along two axes based on the target topographic region.

First antenna chassis 50 further comprises a set of first chassis mounts 60 for receiving posts 16. Each first chassis mount 60 has a set of chassis mounting holes 62 for mounting first antenna chassis 50 to post 16. Preferably, a set of upper and lower chassis positioning holes (not shown) are spaced apart long each post 16 at a predetermined distance from base unit 18 corresponding to the first and second predetermined vertical distances from base unit 18. The position of the chassis positioning holes (not shown) is such that first antenna assembly 12 will be located at the first predetermined vertical distance from base unit 18 when chassis mounting holes 62 of fist antenna assembly 12 are aligned with the upper chassis positioning holes (not shown) on posts 16. Second antenna assembly 14 will be located at the second predetermined vertical distance from base unit 18 when chassis mounting holes 62 of second antenna assembly 14 are aligned with the lower chassis positioning holes on posts 16. First antenna chassis 50 is held in place on posts 16 preferably by placing a screw (not shown), a bolt (not shown), or a locking pin (not shown) into chassis mounting holes 62 when chassis mounting holes 62 are aligned with the appropriate chassis positioning holes (not shown) on posts 16. First chassis mounts 60 have a radio wire hole 64, which aligns with a post radio wire hole (not shown) when first antenna chassis 50 is properly positioned on posts 16.

First antenna chassis 50 has cover mounting holes 66 along a peripheral edge 68 of first antenna chassis 50 for securing an upper and lower cover (FIGS. 8A and 8B and FIGS. 9A and 9B, respectively) to first antenna chassis 50. First antenna chassis 50 has two ducts (not shown) extending through antenna chassis 50. On an upper surface 70 of first antenna chassis 50, a first fan 72 and a first screen 74 each rest on top of one of the two ducts (not shown). First fan 72 is adapted for being connected to a power supply and when activated causes air to circulate through the two ducts, flowing over an upper and a lower portion of first antenna assembly 12. The circulating air can be used to regulate the effective temperature within first antenna assembly 12.

Figure 5:
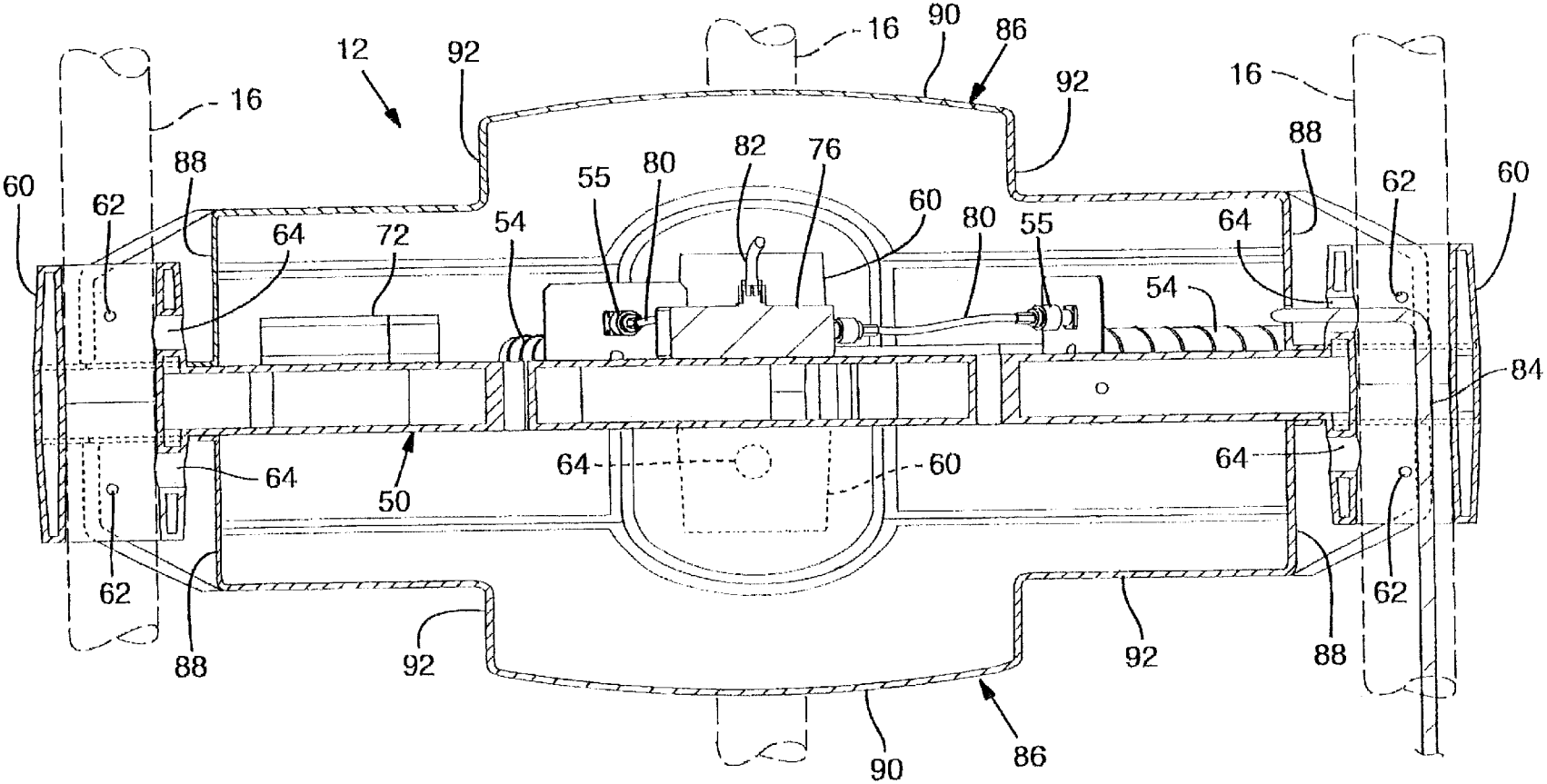
FIG. 5 is a sectional view of the antenna chassis of FIGS. 4A and 4B enclosed by an upper and lower cover and taken along line 5—5 of FIGS. 4A and 4B.

Antenna assembly 12 has a signal splitter 76, either a 2 way or a 4 way Wilkinson divider. Antenna assembly 12 also has a signal amplifier 78. Signal amplifier 78 is preferably a 1 watt amplifier when signal splitter 76 is a 2 way Wilkinson divider. Alternatively, signal amplifier 78 is preferably a 2 watt amplifier when signal splitter 76 is a 4 way Wilkinson divider. Both signal splitter 76 and signal amplifier 78 are supported by upper surface 70 of first antenna chassis 50. Signal splitter 76 is operably connected to first antennas 54, preferably by a set of first antenna wires 80. Signal splitter 76 is operably connected to signal amplifier 78 by an amplifier wire 82. Signal amplifier 78 is adapted for being operably connected to the radio (not shown) by a radio wire 84. Radio wire 84 extends through radio wire hole 64 and enters into post 16, as shown in FIG. 5. Radio wire 84 extends downward through hollow post 16 and is adapted for connection to the radio. All wires are preferably model LMR 195 cable, manufactured by Times Microwave Systems, having a length that corresponds approximately to an integer multiple of the peak wavelength of antenna tower 10. Preferably, posts 16 will have electronics box holes (not shown) positioned to allow radio wire 84 to enter electronics box 20 through a corresponding hole in electronics box 20 such that radio wire 84 is not exposed to any external elements.

First antennas 54 are preferably a set of four dielectric loaded helical antennas, with a peak operating frequency of approximately 2.4 Ghz. First antennas 54 have a standard male N-type connector for attaching first antennas to signal splitter 76 with first antenna wires 80. The length of first antennas 54 may be varied based upon the target topographic region or other requirements for antenna tower 10. Typical first antennas 54 will be a helical antenna with 5-turns, 7-turns, 10-turns, 12-turns, or 20-turns. The gain of first antennas 54 in this embodiment has a roughly proportional to the number of turns, such that increasing the number of turns increases the antennas gain. The beam width for first antennas 54 in this embodiment is roughly inversely proportional to the number of turns, such that increasing the number of turns results in a more focused beam pattern for first antennas 54. Antenna tower 10 may be customized by selection of different length first antennas 54 based on the target topographic region, the configuration of a network of antenna towers 10, or a predetermined desired signal coverage for antenna tower 10. For example all first antennas 54 could be 5-turn antennas resulting in antenna tower 10 having a signal coverage area that is relatively wide. However, the radio frequency signal in this design signal will be relatively weak and effective for only a relatively short distance from antenna tower 10. Alternatively, all first antennas 54 could be 12-turn antennas. This design would result in antenna tower 10 having a relatively stronger radio frequency signal that is effective for greater distances. However, the signal coverage area of 12-turn antennas is narrower than 5-turn antennas which may result in gaps, or dead spots in the signal coverage of antenna tower 10, where little or no radio frequency signal can be received. In another alternative, first antennas 54 may be a combination of antennas ranging from 5-turn to 20-turn antennas for a more complex signal coverage for antenna tower 10. The preferred length of first antennas 54 corresponds to a 5-turn antenna, though others lengths may be used depending upon various factors. For example longer length antennas such as 7-turn, or 10-turn, antennas work well for point-to-point communication between cell towers.

In an alternative embodiment (not shown), each first antenna is operably connected to one radio. In this embodiment, each first antenna 54 is connected to separate signal amplifier 78 by separate amplifier wire 82. Each signal amplifier 78 is connected to a radio (not shown) in electronics box 20 by a separate radio wire 84, as described above. This embodiment gives antenna tower 10 more capacity to transfer and receive data, because each first antenna 54 is functionally independent of each other first antenna 54. In another alternative embodiment (not shown), first antennas 54 are linked in pairs. In this alternative embodiment, a set of two signal splitters (not shown) rests on first antenna chassis 50, each signal splitter of the set of signal splitters being a two-way signal splitter. Two of first antennas 54, preferably separated by 180 degrees, are operably coupled to a first one of the set of signal splitters (not shown) by an antenna wire (not shown). The other two of first antennas 54 are operably coupled to a second one of the set of signal splitters (not shown) by an antenna wire (not shown). Two signal amplifiers 78 rest on first antenna chassis 50. Each signal splitter (not shown) is coupled to one of two signal amplifiers 78 by an amplifier wire 82. Each signal amplifier 78 is operably coupled to a separate radio housed in electronics box 20 by a radio wire 84, as described above.

Figure 6:
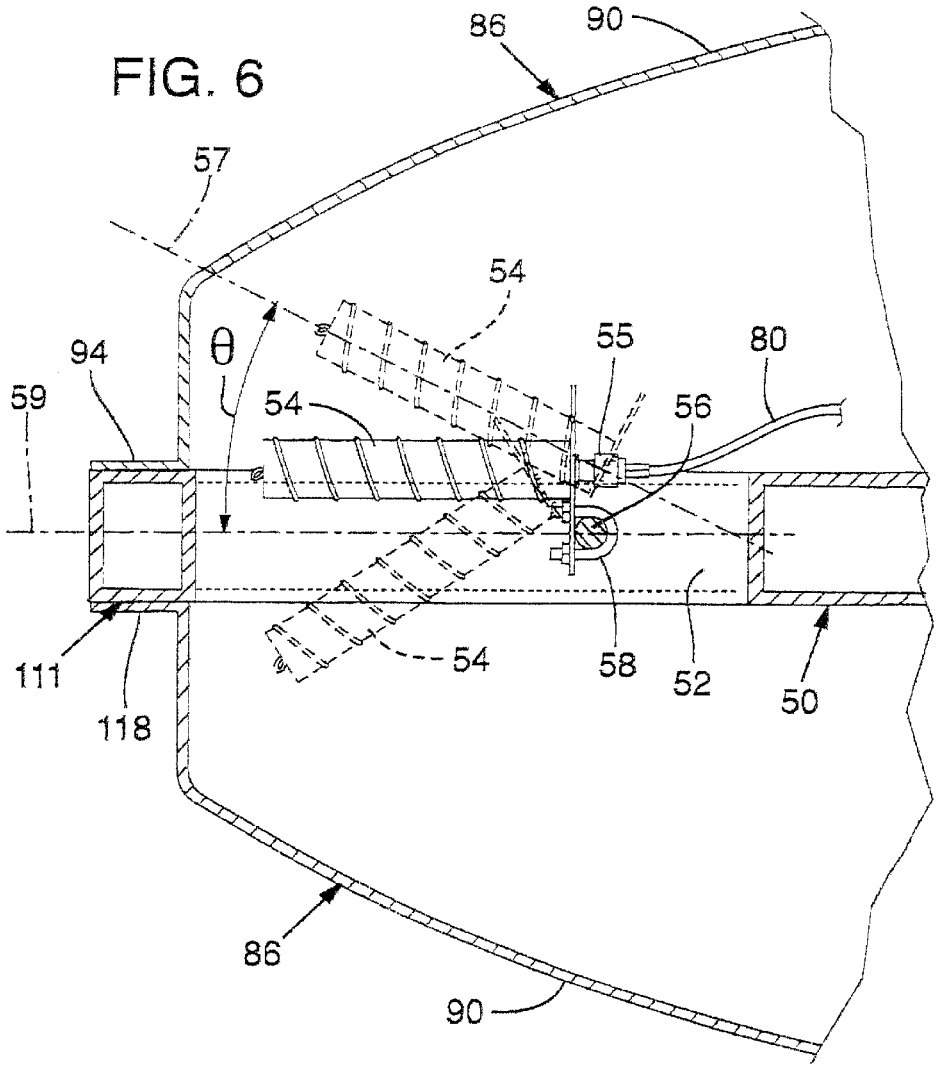
FIG. 6 is a sectional view of the antenna chassis of FIGS. 4A and 4B enclosed by an upper and lower cover and taken along line 6—6 of FIGS. 4A and 4B.

FIG. 5 is a sectional view of first antenna chassis 50 covered by an upper cover 86 and a lower cover 88 (which form a radome for first antenna chassis 50), taken along line 5—5 of FIGS. 4A and 4B. FIG. 6 is a sectional view of first antenna chassis 50 covered by upper cover 86 and lower cover 88, taken along line 6—6 of FIGS. 4A and 4B. With reference to FIGS. 5 and 6, first antenna chassis 50 is hollow and preferably made of a material, such as plastic or polyethylene, that is substantially transparent to radio-frequency signals. With reference to FIG. 6, the axis of rotation for first antennas 54 is shown in greater detail. Each first antenna 54 can be rotated around mounting post 56 until it is at a desired antenna angle of inclination θ, measured between. Once the desired antenna angle of inclination θ is achieved, each first antenna 54 is secured in place by tightening fasteners 58. This allows each antenna to be adjusted based on the topography of the surrounding region, preferably prior to installation at, or shipment to, a target site.

Figure 7:
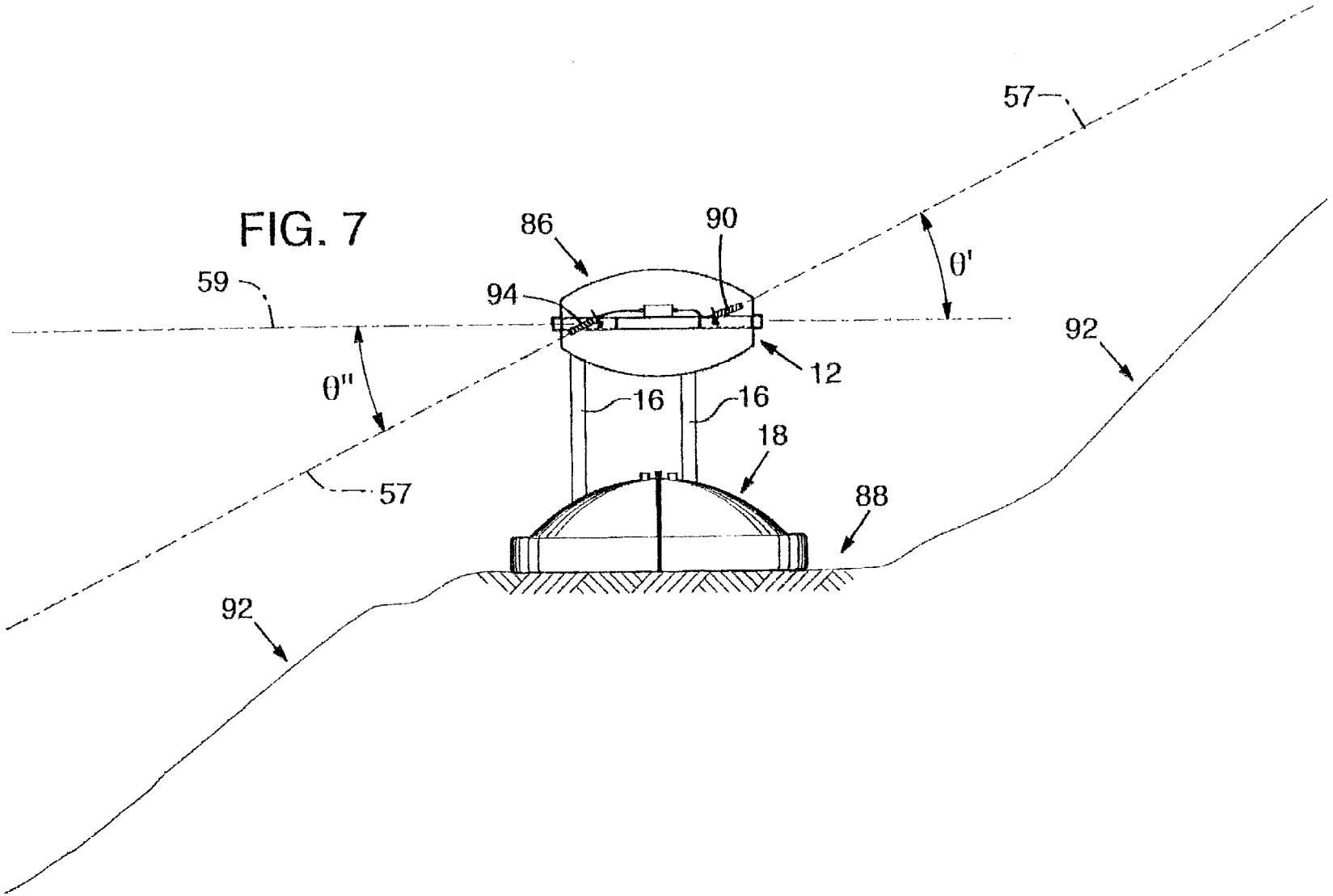
FIG. 7 is a simplified antenna tower installed at a predetermined tower site with a known topography.

FIG. 7 shows a simplified antenna tower 86 installed at a predetermined tower site 88 with a known topography. With reference to FIG. 7, first antenna assembly 12 has been preconfigured for predetermined tower site 88. A first antenna 90, of first antennas 54 has been adjusted, as described above, so that its antenna angle of inclination θ' has a positive value in order to adjust the signal coverage of simplified antenna tower 86 to compensate for a hill 92. A second antenna 94, of first antennas 54, has been adjusted, as described above, so that its antenna angle of inclination θ" has a negative value in order to adjust the signal coverage of simplified antenna tower 86 to compensate for a valley 96. To further simplify installation of simplified antenna tower 86 at predetermined tower site 88, base unit 18, and/or first antenna assembly 12, may be marked with a magnetic north indicator (not shown). In that way, simplified antenna tower 86 will be properly aligned for the known topography if an installer points the magnetic north indicator (s) in the direction of magnetic north, such as by aligning the magnetic north indicator with a magnetic north reading from a reasonably accurate compass. Though this preconfiguration discussion focuses on a simplified antenna tower 86, the preconfiguration is equally applicable to antenna tower 10.

Figure 8A:
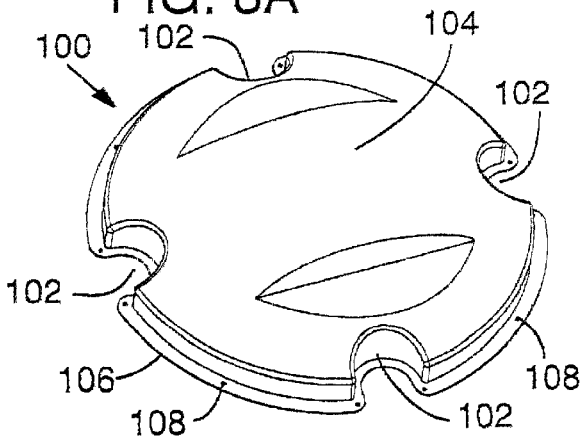
FIG. 8A is a top perspective view of the upper cover of the modular radio-frequency antenna tower of FIG. 1.
Figure 8B:
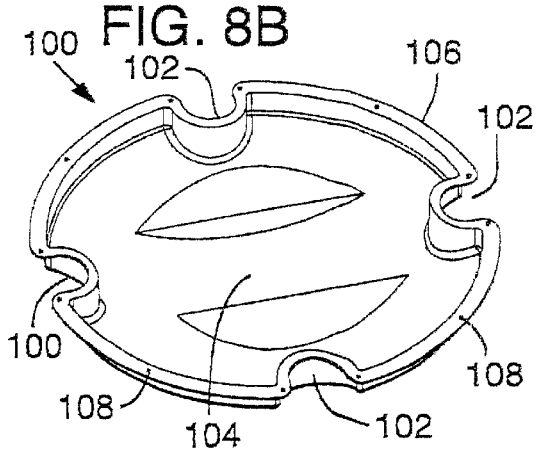
FIG. 8B is a bottom perspective view of the upper cover of the modular radio-frequency antenna tower of FIG. 1.

FIGS. 8A and 8B are respective top and bottom perspective views of upper cover 100 of first antenna assembly 12. Upper cover 100 has a first set of post indentations 102 sized to allow upper cover 100 to be attached to upper surface 70 of first antenna chassis 50. Upper cover 100 has an upper convex surface 104. Upper cover 100 has an upper cover attachment flange 106 for attaching upper cover 100 to first antenna chassis 50. Preferably, upper cover attachment flange 106 includes a set of upper cover attachment holes 108. Upper cover 100 is attached to upper surface 70 of first antenna chassis 50 by securing upper cover attachment holes 108 to cover mounting holes 66 of first antenna chassis 50 with a fastener such as a screw, bolt, nylon through hole bolt, or locking pin.

Figure 9A:
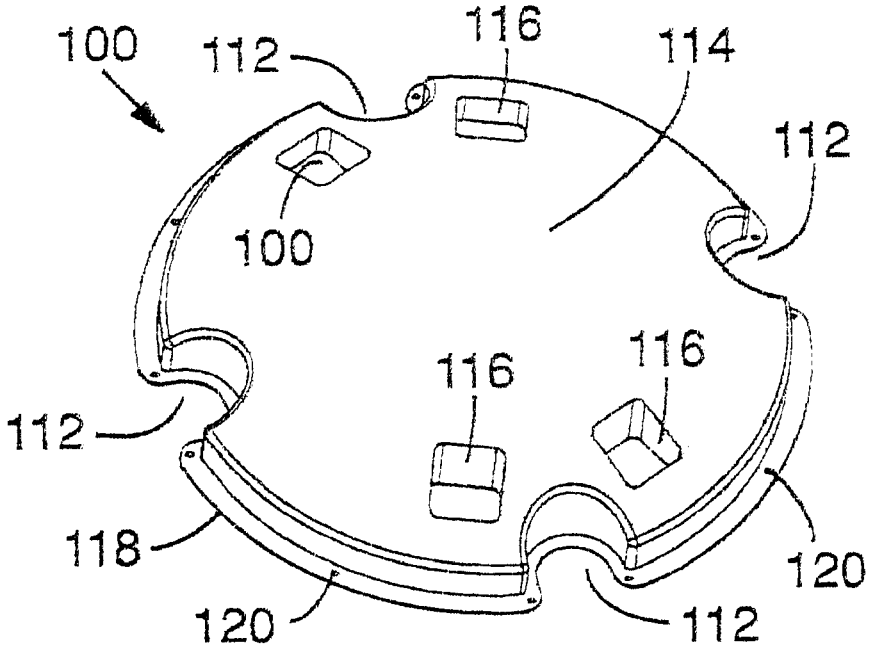
FIG. 9A is a bottom perspective view of the lower cover of the modular radio-frequency antenna tower of FIG. 1.
Figure 9B:
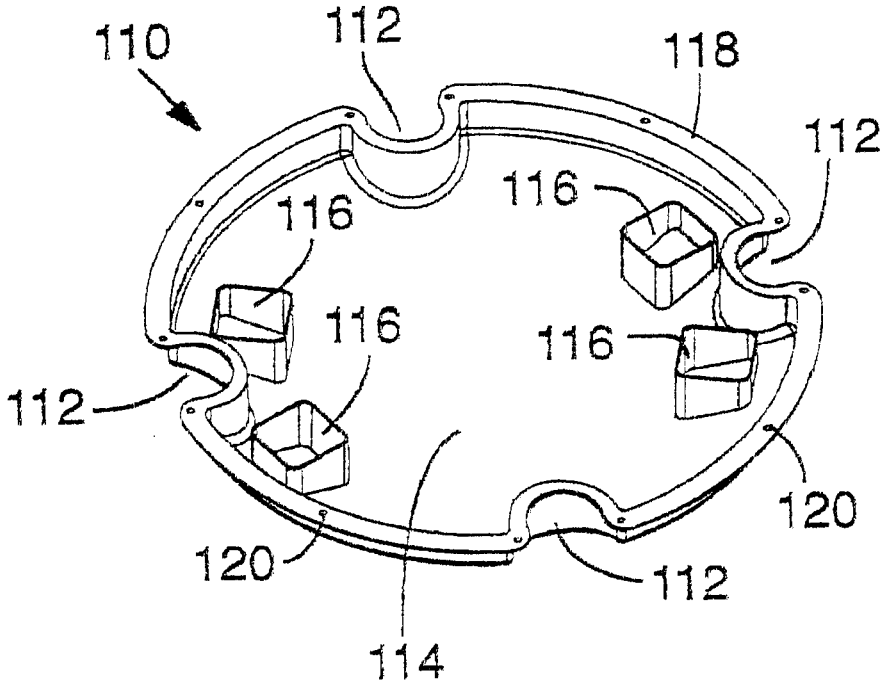
FIG. 9B is a top perspective view of the lower cover of the modular radio-frequency antenna tower of FIG. 1.

FIGS. 9A and 9B are respective bottom and top perspective views of lower cover 110 of first antenna assembly 12. Lower cover 110 has a first lower set of post indentations 112, sized to allow lower cover 110 to be attached to a lower surface 111 (FIG. 6) of first antenna chassis 50. Lower cover 110 has a lower convex surface 114. Lower cover 110 has a set of lower vents 116, which allow air to flow into and out of first antenna chassis 50. Lower cover 110 has a lower cover attachment flange 118 for attaching lower cover 110 to first antenna chassis 50. Preferably, lower cover attachment edge 118 includes a set of lower cover attachment holes 120. Lower cover 110 is attached to the lower surface 111 (FIG. 6) of first antenna chassis 50 by securing lower cover attachment holes 120 to cover mounting holes 66 of first antenna chassis 50 with a fastener, such as a screw, a bolt or a locking pin.

The foregoing description of FIGS. 4A, 4B, 5, 6, 7, 8A, 8B, 9A, and 9B focuses on first antenna assembly 12, but the detail disclosed is equally applicable to second antenna assembly 14, which has substantially the same structure as first antenna assembly 12. First assembly 12 and second assembly 14 are preferrably rotationally offset from one another by approximately 45 degrees about a vertical axis of antenna tower 10. This configuration results in antenna tower 10 to have increased signal capacity and can improve the signal coverage of antenna tower 10 because the first antennas 54 and second antennas (not shown) have minimal overlap in the beam patterns of their respective antennas.

It will be obvious to those having skill in the art that many changes may be made to the details of the above-described embodiments of this invention without departing from the underlying principles thereof. The scope of the present invention should, therefore, be determined only by the following claims.

What is claimed is:

1. A portable broadband antenna tower for use in a target topographic region comprising:

a base unit;

a post supported on the base unit;

a first antenna chassis positioned on the post at a first predetermined vertical distance from the base unit, the first antenna chassis having a first set of recesses spaced about the first antenna chassis in a first generally planar relationship for receiving a first set of antennas, each recess of the first set of recesses being a predetermined distance from adjacent recesses of the first set of recesses;

a second antenna chassis positioned at a second predetermined vertical distance from the base unit, having a second set of recesses spaced about the second antenna chassis in a second generally planar relationship for receiving a second set of antennas, each recess of the second set of recesses being a predetermined distance from adjacent recesses of the second set of recesses; and first and second sets of antennas rotatably mounted in the first and second set of recesses, respectively, such that each antenna can be adjusted based on the target topographic region.

2. The tower of claim 1 in which the difference between the first and second predetermined vertical distances is based on a range of radio frequencies which the tower will transmit and respond to, in order to minimize interference between the first set of antennas and the second set of antennas.

3. The tower of claim 1 in which the first and the second antenna chassis are positioned such that the first and second sets of recesses are rotationally offset relative to each other.

4. The tower of claim 3 in which the first and second antenna chassis are positioned relative to each other such that the tower can respond to and transmit radio frequency signals in a substantial portion of the target topographic region.

5. The tower of claim 4 further comprising a first signal splitter supported on the first antenna chassis and a first signal amplifier supported on the first antenna chassis, in which each antenna of the first set of antennas is connected by one of a first set of antenna wires to the first signal splitter and the first signal splitter is connected by a first amplifier wire to the first signal amplifier and the first signal amplifier is connected by a first radio wire to a first radio.

6. The tower of claim 5 further comprising a second signal splitter supported on the second antenna chassis and a second signal amplifier supported on the second antenna chassis, in which each antenna of the second set of antennas is connected by one of a second set of antenna wires to the second signal splitter, and the second signal splitter is connected by a second amplifier wire to the second signal amplifier, and the second signal amplifier is connected by a second radio wire to a second radio.

7. The tower of claim 6 in which each wire of the first and second sets of wires, the first and second amplifier wires, and the first and second radio wires has a length of approximately a one quarter wavelength multiple of the peak wavelength of the antennas.

8. The tower of claim 1 in which the first and second sets of antennas are operatively connected to at least one radio.

9. The tower of claim 7 further comprising a first cover attached mounted on the first antenna chassis and covering a portion of the first antenna chassis.

10. The tower of claim 9 further comprising a second cover mounted to the second antenna chassis and covering a portion of the second antenna chassis.

11. The tower of claim 10 further comprising a first fan and in which the first antenna chassis has a first fan duct and a first circulation duct and the first fan rest on the first fan duct and is adapted for connection to a power supply, such that when activated the first fan causes air to circulate around the portions of the first antenna chassis covered by the first cover.

12. A preconfigured modular radio frequency antenna tower comprising:

a first antenna chassis supported on a support structure and having a first set of recesses for receiving a first set of antennas;

each recess of the first set of recesses being positioned a predetermined distance from adjacent recesses such that a signal of each antenna of the first set of antennas will be substantially free from interference from the signal of adjacent antennas of the first set of antennas;

a second antenna chassis adapted for being positioned a predetermined vertical distance from the first antenna chassis and having a second set of recesses for pivotally receiving a second set of antennas;

each recess of the second set of recesses being positioned a predetermined distance from adjacent recesses such that a signal of each antenna of the second set of antennas will be substantially free from interference from a signal of adjacent antennas of the second set of antennas.

13. The tower of claim 12 in which the first antenna chassis and second antenna chassis are rotationally oriented relative to each other, about a generally vertical axis, such that the antenna tower can respond to and transmit radio frequency communications throughout a selected portion of a target topographic region.

14. The tower of claim 13 in which the first set of antennas are operably coupled to a first radio.

15. The tower of claim 13 further comprising a first signal splitter supported on the first antenna chassis and a first signal amplifier supported on the first antenna chassis in which each of the first set of antennas is operably coupled to the first signal splitter and the first signal splitter is operably coupled to the first radio.

16. A method of making a modular wireless broadband antenna tower comprising the steps of:

identifying a target geographic region of operation for the wireless broadband antenna tower;

selecting a base location within the target region to locate the wireless broadband antenna tower;

selecting a number of antennae for installation in the antenna tower;

at a factory, mounting the selected number of antenna onto a rigid chassis, said mounting step including arranging the antennae with an angular spacing so that, in combination, the installed antennae are substantially aligned for transmission and reception of radio frequency signals over a predetermined angular range of the tower;

said mounting step including allocating each antenna to a corresponding portion of the predetermined angular range;

determining a topography of the target geographic region relative to the selected base location;

at the factory, aiming each antenna on the chassis at a selected vertical angle offset from a horizontal plane in response to the topography of the target geographic region over the corresponding portion of the predetermined angular range of the tower;

transporting the chassis to the selected base location; and at the base location, installing the chassis on a substantially rigid structure, said installing step including rotationally aligning the chassis so that the antennae are aligned with their respective portions of the predetermined angular range of the tower, whereby the tower is preconfigured for use at the selected site.

* * * * *